US006131009A

United States Patent [19]

Hasegawa

[11] Patent Number: 6,131,009

[45] Date of Patent: Oct. 10, 2000

[54] FUSING DEVICE, METHOD AND COMPUTER READABLE MEDIUM FOR AN IMAGE FORMING APPARATUS USING CONTROLLED ROTATION OF FUSING AND PRESSURE ROLLERS

[75] Inventor: Kenichi Hasegawa, Kawasaki, Japan

[73] Assignee: Ricoh Company, Ltd., Tokyo, Japan

[21] Appl. No.: 09/412,603

[22] Filed: Oct. 6, 1999

[30] Foreign Application Priority Data

Oct. 27, 1998 [JP] Japan ..... 10-305796
Feb. 10, 1999 [JP] Japan ..... 11-032862

[51] Int. Cl.[7] ..... G03G 15/20

[52] U.S. Cl. ..... 399/328; 399/68

[58] Field of Search ..... 399/328, 67, 68, 399/330, 331, 338; 219/216

[56] References Cited

U.S. PATENT DOCUMENTS 5,481,349 1/1996 Satoh et al. ..... 399/328

FOREIGN PATENT DOCUMENTS 5-333737 12/1993 Japan .
2769856 4/1995 Japan .
7-261592 10/1995 Japan .
09044024 2/1997 Japan .
10240063 9/1998 Japan .

*Primary Examiner*—Quana Grainger
*Attorney, Agent, or Firm*—Oblon, Spivak, McClelland, Maier & Neustadt, P.C.

[57] ABSTRACT

A fusing device, method and computer readable medium including a fusing roller which fuses toner images on a sheet; a pressure roller which contacts the fusing roller with pressure; and a driving device for driving the fusing and pressure rollers; wherein the driving device drives the fusing and pressure rollers so as to satisfy the following inequality:

$$D_{fr}/D_{pr}<N_{pr}/N_{fr},$$

where $D_{fr}$ is a diameter of the fusing roller, $D_{pr}$ is a diameter of the pressure roller, $N_{fr}$ is a number of rotations of the fusing roller, and $N_{pr}$ is a number of rotations of the pressure roller.

13 Claims, 5 Drawing Sheets

FIG. 3

| NUMBER OF TEETH IN FUSING ROLLER GEAR 17 (A) / NUMBER OF TEETH IN PRESSURE ROLLER GEAR 18 (B) | 80/81 | 80/80 | 80/79 | 80/78 | 80/77 |
|---|---|---|---|---|---|
| A / B | 0.988 | 1 | 1.013 | 1.026 | 1.039 |
| OCCURRENCE RATE OF WRINKLES | × | × | △ | ◎ | ◎ |

◎ : Occurrence rate of wrinkles is ZERO

△ : Occurrence rate of wrinkles is from 10% and greater to less than 50%

× : Occurrence rate of wrinkles is 50% and greater

FIG. 4

| NUMBER OF TEETH IN FUSING ROLLER GEAR 17 (A) / NUMBER OF TEETH IN PRESSURE ROLLER GEAR 18 (B) | 65/66 | 65/65 | 65/64 | 65/63 | 65/62 |
|---|---|---|---|---|---|
| A / B | 0.985 | 1 | 1.016 | 1.032 | 1.048 |
| OCCURRENCE RATE OF WRINKLES | × | × | ○ | ◎ | ◎ |

◎ : Occurrence rate of wrinkles is ZERO

○ : Occurrence rate of wrinkles is less than 10%

× : Occurrence rate of wrinkles is 50% and greater

FUSING DEVICE, METHOD AND COMPUTER READABLE MEDIUM FOR AN IMAGE FORMING APPARATUS USING CONTROLLED ROTATION OF FUSING AND PRESSURE ROLLERS

BACKGROUND OF THE INVENTION

1. Field of the Invention

The present invention relates to a fusing device, method and computer readable medium using a heat roller, for use in an image forming apparatus, such as a printer, a facsimile, a photocopier, etc.

2. Discussion of the Background

Generally, a heat roller fusing device included in an electrophotographic image forming apparatus includes a fusing roller with a heater, a pressure roller which contacts and rotates with the fusing roller, and a driving device which rotates the fusing roller. The driving device includes gears and gear driving parts which are provided, for example, at an end portion of the fusing roller.

Toner images formed on a sheet are fused on the sheet under the influence of heat and pressure after passing through a contact part, i.e., a nip part between a fusing roller and a pressure roller. Although the sheet may have wrinkles in a fusing process while passing through the nip part between the fusing roller and the pressure roller, occurrence of wrinkles is generally prevented by making a shape of the fusing roller such that a diameter of both end sides thereof is greater than a diameter of a center part thereof. As a result, the end sides of the sheet are transferred at a faster rate than the center part of the sheet and the sheet is thereby stretched, so that occurrence of wrinkles is typically reduced.

In Japanese Laid-open Patent Publication No. 5-333737, a fusing device is described in which a driving force transmission mechanism is provided to transmit a driving force to a fusing roller when a paper sheet (i.e., single sheet) is transferred between the fusing roller and a pressure roller. When an envelope (i.e., double sheet) is transferred therebetween, the driving force is also transferred to the pressure roller via the driving force transmission mechanism so as to make the transfer speed of the envelope at the fusing roller side and the pressure roller side substantially equal.

In Japanese Laid-open Patent Publication No. 7-261592, another fusing device is described in which, in order to avoid sheet shifting and occurrence of wrinkles even when several thicknesses of sheets and envelops are printed at high speed, a fusing roller and a pressure roller are driven as driving rollers, respectively, when several thicknesses of sheets or an envelop is printed. When, however, a single sheet is transferred, the pressure roller is switched to be the only driven roller.

In the above-described background fusing devices, wrinkles are avoided on the envelop and the several thicknesses of sheets by making the velocity of the surfaces of the fusing and pressure rollers substantially equal.

However, in a full color image forming apparatus, wrinkles may occur on sheets in a two-sided copy mode even though the velocity of the surfaces of the fusing and pressure rollers are kept substantially equal. The toner layers of full color images are typically thicker than those of single color images, and when the toner of the full color images is melted at a nip part between fusing and pressure rollers, a coefficient of friction therebetween significantly drops. In a one-sided copy mode, because there is no toner on a backside of a sheet, the coefficient of friction remains constant and a velocity distribution error is less likely to occur. In a two-sided copy mode, however, because the coefficient of friction at an image portion and a non-image portion is different on each side of a sheet, the velocity distribution error of the sheet transfer speed at a nip part between a fusing roller and a pressure roller occurs, and thereby wrinkles typically are generated on the sheet.

SUMMARY OF THE INVENTION

Accordingly, the present invention has been made in view of the above-discussed problems with the background devices and a method and an object of the invention is to address these problems.

Another object of the present invention is to provide a novel heat roller fusing device, method and computer readable medium, in which wrinkles do not occur on a sheet even when a full color image is copied in a two-sided copy mode.

The above and other objects of the invention are achieved by providing a novel fusing device, method and computer readable medium including a fusing roller which fuses toner images on a sheet; a pressure roller which contacts the fusing roller with pressure; and a driving device for driving the fusing and pressure rollers; wherein the driving device drives the fusing and pressure rollers so as to satisfy the following inequality:

$$D_{fr}/D_{pr}<N_{pr}/N_{fr},$$

where $D_{fr}$ is a diameter of the fusing roller, $D_{pr}$ is a diameter of the pressure roller, $N_{fr}$ is a number of rotations of the fusing roller, and $N_{pr}$ is a number of rotations of the pressure roller.

In another aspect of the present invention there is provided a novel fusing device, method and computer readable medium including a fusing roller which fuses toner images on a sheet; a pressure roller which contacts the fusing roller with pressure; and a driving device for driving the fusing and pressure rollers; wherein the driving device drives the fusing and pressure rollers so as to satisfy the following inequality:

$$D_{fr}/D_{pr}\leqq(N_{pr}/N_{fr})/1.015,$$

where $D_{fr}$ is a diameter of the fusing roller, $D_{pr}$ is a diameter of the pressure roller, $N_{fr}$ is a number of rotations of the fusing roller, and $N_{pr}$ is a number of rotations of the pressure roller.

Other objects, features, and advantages of the present invention will become apparent from the following detailed description when read in conjunction with the accompanying drawings.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein:

FIG. 3 is a table showing the results of a first experiment to determine an occurrence rate of wrinkles on a sheet;

FIG. 4 is a table showing the results of a second experiment to determine an occurrence rate of wrinkles on a sheet;

DESCRIPTION OF THE PREFERRED EMBODIMENTS

Figure 1:
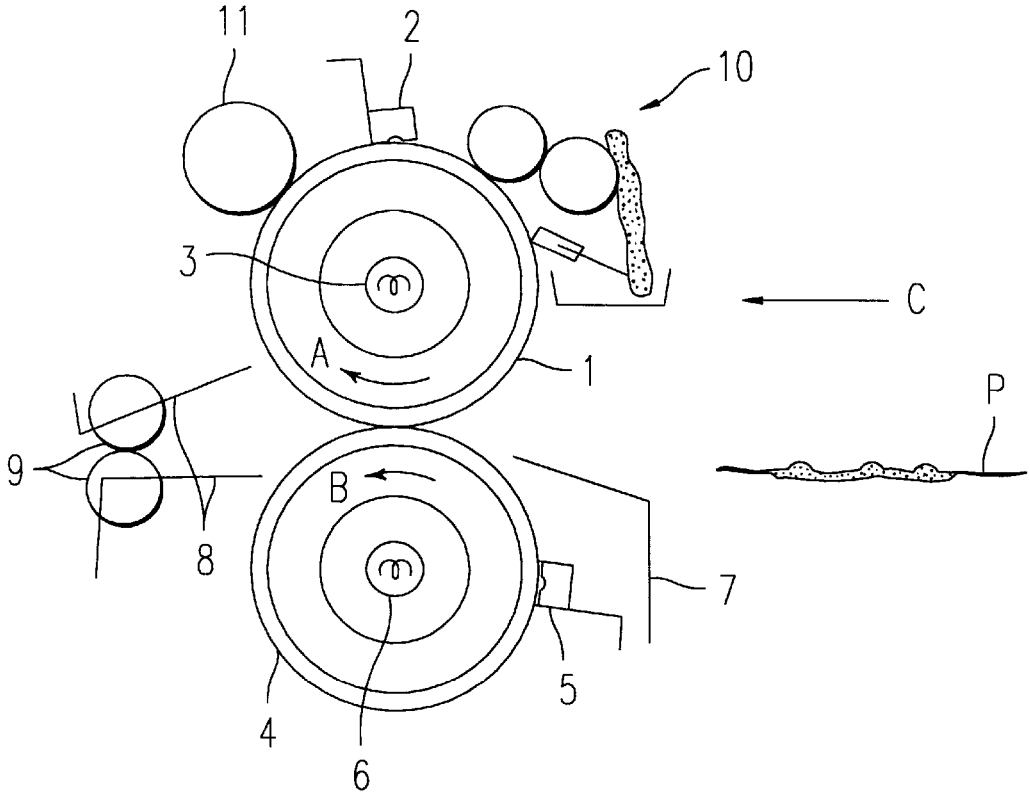
FIG. 1 is a schematic side-view illustrating an embodiment of a fusing device of the present invention.

Referring now to the drawings, wherein like reference numerals designate identical or corresponding parts throughout the several views, and more particularly to FIG. 1 thereof, there is illustrated a heat roller fusing device of a full color image forming apparatus, including a fusing roller 1 and a pressure roller 4.

In FIG. 1, the fusing roller 1 includes layers of silicone rubber on the surface of a metal pipe or the like. A thermistor 2 is provided, which contacts the surface of the layers of silicone rubber of the fusing roller 1 and which detects a temperature of the surface of the fusing roller 1. A temperature control unit (not shown) turns on and off a heater 3 and keeps the temperature of the surface of the fusing roller 1 at about 160° C.

The pressure roller 4 has a similar structure as that of the fusing roller 1, e.g., including a thermistor 5 and a heater 6, and which contacts the fusing roller 1 with pressure supplied by a pressure device (not shown), and which rotates with the fusing roller 1. The fusing roller 1 rotates in the direction indicated by an arrow A, and the pressure roller 4 rotates in the direction indicated by an arrow B.

A sheet P with a non-fused toner image advances along an entrance guide plate 7 to a nip part between the fusing roller 1 and the pressure roller 4, and then the toner image is fused on the sheet P by the action of heat and pressure. On the exemplary sheet P illustrated in FIG. 1, a toner image is already fused on the backside thereof. After passing through the nip part, the sheet P is transferred along an exit guide plate 8 and is discharged from the fusing device by a pair of discharging rollers 9.

In order to avoid the sticking of toner to the fusing roller 1 which is fused at the nip part, the surface of the fusing roller 1 is formed with silicone rubber and is applied evenly with silicone oil by an oil applying mechanism 10. However, because a small quantity of toner typically sticks to the fusing roller 1, a cleaning roller 11 is typically provided downstream of the rotational direction indicated by the arrow A of the fusing roller 1 so as to remove the toner on the fusing roller 1.

Figure 2:
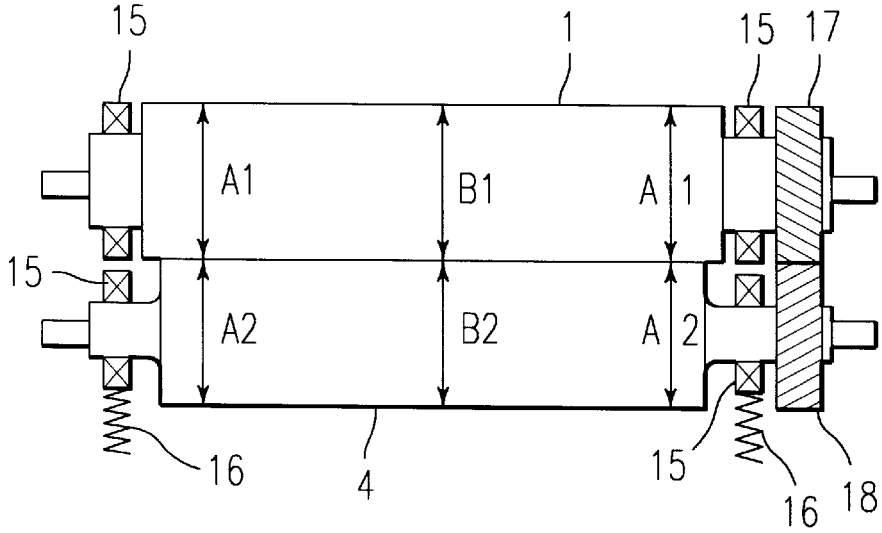
FIG. 2 is a schematic front-view of the fusing device illustrated in FIG. 1 according to an embodiment of the present invention.

FIG. 2 illustrates the fusing device of the present invention looking from the direction indicated by an arrow C in FIG. 1. In FIG. 2, the fusing roller 1 is supported by bearings 15 at both ends, and the bearings 15 are fixed to a housing case (not shown). The pressure roller 4 is also supported by bearings 15, and is maintained in press-contact with the fusing roller 1 by a biasing device 16, such as a spring. In order to avoid the occurrence of wrinkles on a sheet, the fusing roller 1 and the pressure roller 4 are shaped such that diameters a1 and a2 of both sides of the fusing roller 1 and the pressure roller 4, respectively, are slightly greater than respective diameters b1 and b2 at center parts thereof. As the difference between a1 and b1 and between a2 and b2 becomes greater, wrinkles occur less frequently. However, an image blurring may occur as the above-noted difference becomes greater. In the preferred embodiment, the difference between a1 and b1 and between a2 and b2 is generally set to be about 0.03 mm in order to reduce the occurrence of wrinkles and in order to avoid image blurring.

Further, in order to avoid wrinkles on a sheet and slipping of the pressure roller 4 due to the silicone oil, a fusing roller gear 17 and a pressure roller gear 18 are provided at one end of the fusing roller 1 and the pressure roller 4, respectively. The fusing roller gear 17 is driven by an input gear (not shown) of the main body of the image forming apparatus. The pressure roller gear 18 is driven by the fusing roller gear 17. Generally, the surface speed of the fusing roller 1 and pressure roller 4 is made substantially equal, and the following relation is satisfied:

$$D_{fr}/D_{pr}=T_{fr}/T_{pr},$$

where $D_{fr}$ is the diameter of fusing roller 1, $D_{pr}$ is diameter of pressure roller 4, $T_{fr}$ is the number of teeth of fusing roller gear 17 and $T_{pr}$ is the number of teeth of pressure roller gear 18.

Although there are other ways to make the surface speed of the fusing roller 1 and the pressure roller 4 substantially equal, the above-described structure of the fusing device to which the above-described relation applied allows a decrease in the number of component parts and provides accurate surface speed for the fusing roller 1 and the pressure roller 4, as compared to background methods and devices.

However, it was discovered that wrinkles occur on a sheet even in a fusing device with the above-described structure, when a full color image of larger than A4 size is copied at a center part of an A3 sized sheet in a two-sided copy mode. Specifically, the coefficient of friction drops due to fused toner at the center part of the A3 sized sheet, while the coefficient of friction remains the same on the outside of the image because no toner is fused thereon. As a result, a velocity distribution error occurs on the sheet, typically causing wrinkles. On the other hand, when the above-described image is copied in a one-sided copy mode, wrinkles do not typically occur. It is assumed that the velocity distribution error does not occur on the backside of the sheet because no toner is fused thereon, and thereby the sheet is prevented from wrinkling even though the velocity distribution error occurs on the front side of the sheet.

Based on experiments, it was discovered that wrinkles can be prevented by (i) making the velocity of the front and back side of a sheet different, i.e., making the surface speed of the fusing roller 1 and the pressure roller 4 different, and (ii) by affording rigidity to a sheet.

FIG. 3 is a table showing the results of a first experiment to determine an occurrence rate of wrinkles on a sheet when a full color image of larger than A4 size is copied at a center part of an A3 sized sheet in a two-sided copy mode. In this experiment, a difference of velocity is caused by changing the number of teeth of the pressure roller gear 18 (i.e., B) while maintaining the number of teeth of the fusing roller gear 17 (i.e., A) constant at 80 teeth. The diameter of the fusing roller 1 and the pressure roller 4 is set to be 80 mm in the full color fusing device illustrated in FIG. 1. The occurrence rate of wrinkles is obtained by the following calculation:

$$N_{sw}/N_{sf},$$

where $N_{sw}$ is the number of sheets on which wrinkles occur and $N_{sf}$ is the number of fed sheets.

The results show that when the number of teeth of the pressure roller gear 18 (i.e., B) is equal to or greater than that of the fusing roller gear 17 (i.e., A), an occurrence rate of wrinkles for the ratios (i.e, A/B) of 0.988 and 1 is 50% or greater. When the number of teeth of the fusing roller gear 17 (i.e., A) is 80 and the number of teeth of the pressure roller gear 18 (i.e., B) is 79, the occurrence rate of wrinkles for the ratio (i.e, A/B) of 1.013 is from 10% and greater to less than 50%. When the number of teeth of the fusing roller gear 17 (i.e., A) is 80 and the number of teeth of the pressure roller gear 18 (i.e., B) are 78 and 77, the occurrence rate of wrinkles for the ratios (i.e, A/B) of 1.026 and 1.039 is zero. From this table, it can be seen that wrinkles can be prevented or reduced when the number of teeth of the pressure roller gear 18 (i.e., B) is smaller than that of the fusing roller gear 17 (i.e., A). In other words, wrinkles can be prevented or reduced when a number of rotations of the pressure roller 4 is greater than that of the fusing roller 1, i.e., velocity at the surface of the pressure roller 4 is faster than that of the fusing roller 1. Accordingly, the following relations are satisfied:

$$D_{fr}/D_{pr}<T_{fr}/T_{pr}, \text{ or}$$

$$D_{fr}/D_{pr}<N_{pr}/N_{fr}, \text{ and}$$

wherein if $D_{fr}=D_{pr}$, then:

$$1<T_{fr}/T_{pr}, \text{ or}$$

$$1<N_{pr}/N_{fr},$$

where $D_{fr}$ is the diameter of fusing roller 1, $D_{pr}$ is diameter of pressure roller 4, $T_{fr}$ is the number of teeth of fusing roller gear 17, $T_{pr}$ is the number of teeth of pressure roller gear 18, $N_{fr}$ is the number of rotations of the fusing roller 1, and $N_{pr}$ is the number of rotations of the pressure roller 4.

FIG. 4 is another table showing a result of a second experiment to determine an occurrence rate of wrinkles on a sheet when a full color image of larger than A4 size is copied at a center part of an A3 sized sheet in a two-sided copy mode. In this experiment, the diameter of the fusing roller 1 and the pressure roller 4 is set to 65 mm. In FIG. 4, when the ratio (i.e., A/B) of 1.016 is obtained, an occurrence rate of wrinkles is less than 10%. The wrinkles which occur when the ratio (i.e., A/B) is 1.016 is within an allowable level, i.e., wrinkles are not visible but recognized by touch. When the ratio (i.e., A/B) is set to be 1.016 or greater, wrinkles on a sheet are effectively prevented. Accordingly, the following relations are satisfied:

$$D_{fr}/D_{pr}\leqq(T_{fr}/T_{pr})/1.015, \text{ or}$$

$$D_{fr}/D_{pr}\leqq(N_{pr}/N_{fr})/1.015, \text{ and}$$

wherein if $D_{fr}=D_{pr}$, then:

$$1\leqq(T_{fr}/T_{pr})/1.015, \text{ or}$$

$$1\leqq(N_{pr}/N_{fr})/1.015,$$

where $D_{fr}$ is the diameter of fusing roller 1, $D_{pr}$ is diameter of pressure roller 4, $T_{fr}$ is the number of teeth of fusing roller gear 17, $T_{pr}$ is the number of teeth of pressure roller gear 18, $N_{fr}$ is the number of rotations of the fusing roller 1, and $N_{pr}$ is the number of rotations of the pressure roller 4.

In the above-described first and second experiments, each number of rotations of the fusing roller 1 and the pressure roller 4 is adjusted by changing the number of teeth of the fusing roller gear 17 and the pressure roller gear 18 which are engaged each other. Alternatively, as shown in, for example, FIG. 6, the number of rotations of the fusing roller 1 and the pressure roller 4 may be adjusted by driving the fusing roller 1 and the pressure roller 4 separately, without the use of engaged gears, as will be later described.

In the above-described fusing device, it was found that controlling the difference of velocity between the fusing roller 1 and the pressure roller 4 effectively prevents wrinkles from forming on a sheet. In the fusing device, force originally acts at the nip part between the fusing roller 1 and the pressure roller 4 such that the pressure roller 4 is driven to rotate at the same speed as the fusing roller 1 (hereinafter called "driven rotational force"). However, when the pressure roller 4 is forced to rotate faster than the fusing roller 1 against the above-noted driven rotational force, this causes an overload on both fusing roller gear 17 and pressure roller gear 18.

Further, the driven rotational force evenly acts at the nip part between the fusing roller 1 and the pressure roller 4 in the longitudinal direction. However, as the pressure roller gear 18 is driven by the fusing roller gear 17 at the end of the pressure roller 4, a twisting force is exerted in the longitudinal direction of the fusing roller 1 and the pressure roller 4 when the difference of velocity between the fusing roller 1 and the pressure roller 4 occurs. This is especially true when a roller with a large diameter, e.g., 80 mm, is used, wherein the contact-pressure force of the pressure roller 4 and the driven rotational force is increased. As a result, a contact width of the fusing roller 1 and the pressure roller 4 at the nip part therebetween becomes different due to twists of the fusing roller 1 and the pressure roller 4. Specifically, when the fusing roller 1 and the pressure roller 4 are not driven, the contact width of both rollers is even at both end and center parts thereof. When, however, the fusing roller 1 and the pressure roller 4 are driven to rotate, the contact width of both rollers at the gear side becomes greater than the contact width at the non-gear side due to the twisting of the rollers caused by the twisting force. As a result, problems occur such as an inadequate transfer of sheets and gear destruction due to the extra forces.

Figure 5:
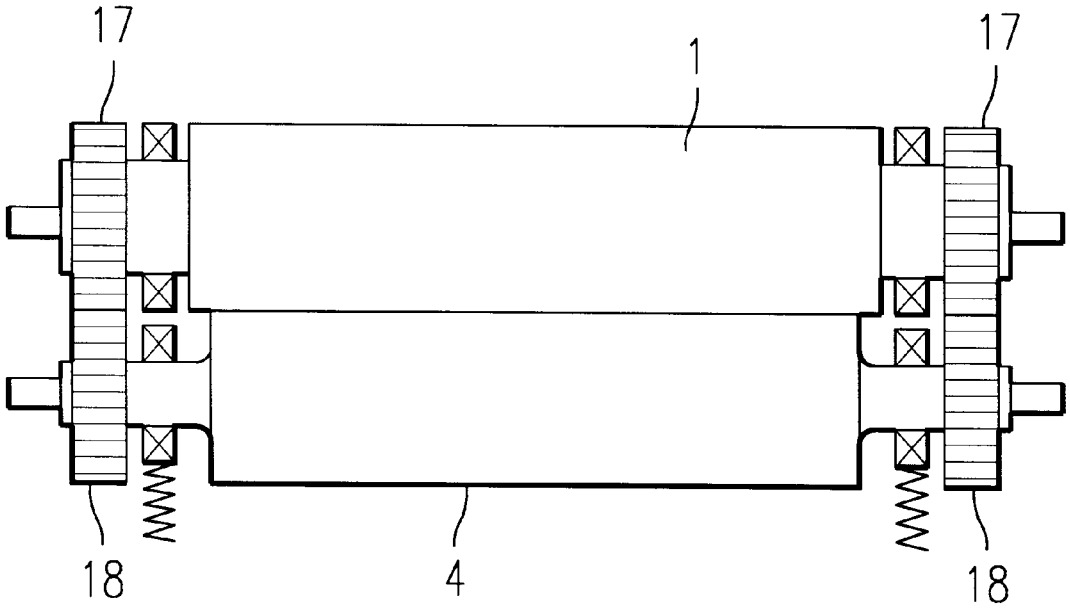
FIG. 5 is a schematic front-view illustrating another embodiment of the fusing device illustrated in FIG. 1.

In order to avoid the above-note problems, as shown in FIG. 5, a pair of fusing roller gears 17 and pressure roller gears 18 are disposed at both ends of the fusing roller 1 and the pressure roller 4, respectively. Thereby, a load for each gear can be reduced by one half, and occurrence of the twisting force at the fusing roller 1 and the pressure roller 4 can be prevented.

Figure 6:
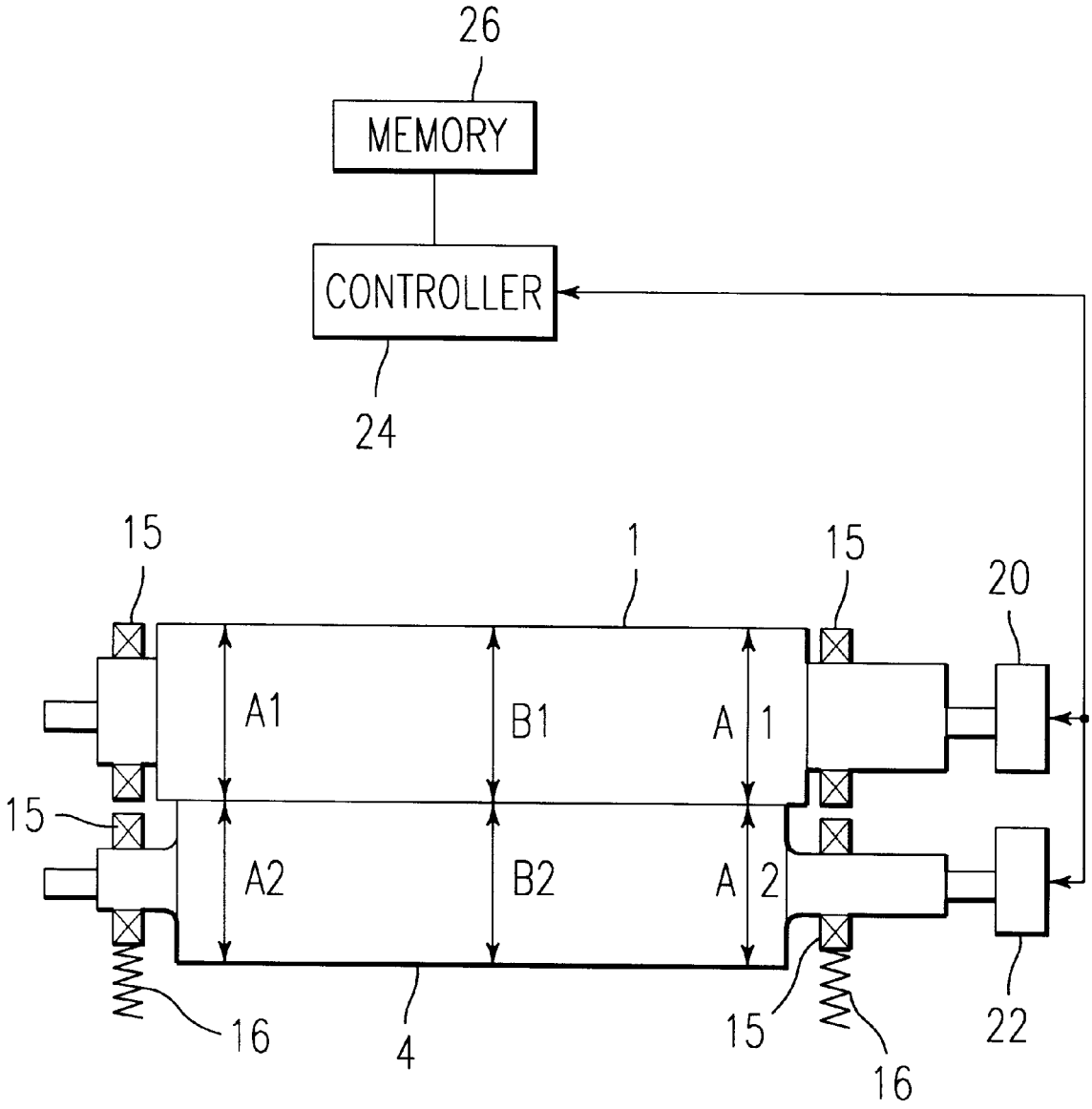
FIG. 6 is a schematic front-view of the fusing device illustrated in FIG. 1 according to another embodiment of the present invention.

As previously discussed and as shown in, for example, FIG. 6, the number of rotations of the fusing roller 1 and the pressure roller 4 may be adjusted by driving the fusing roller 1 and the pressure roller 4 separately via a controller 24, such as a central processing unit (CPU), microprocessor, or the like, for controlling motors 20 and 22, such as stepping motors or the like, respectively coupled to the fusing roller 1 and the pressure roller 4. The controller 24 includes an internal/external memory 26 for storing computer program instructions for controlling the number of rotations of the fusing roller 1 and the pressure roller 4, as previously discussed.

The mechanisms and processes set forth in the present description may be implemented using a conventional general purpose microprocessor programmed according to the teachings in the present specification, as will be appreciated to those skilled in the relevant art(s). Appropriate software coding can readily be prepared by skilled programmers based on the teachings of the present disclosure, as will also be apparent to those skilled in the relevant art(s).

The present invention thus also includes a computer-based product which may be hosted on a storage medium and include instructions which can be used to program a microprocessor to perform a process in accordance with the present invention. This storage medium can include, but is not limited to, any type of disk including floppy disks, optical disks, CD-ROMs, magneto-optical disks, ROMs, RAMs, EPROMs, EEPROMs, flash memory, magnetic or optical cards, or any type of media suitable for storing electronic instructions.

Obviously, numerous additional modifications and variations of the present invention are possible in light of the above teachings. It is therefore to be understood that within the scope of the appended claims, the present invention may be practiced otherwise than as specifically described herein.

This document claims priority and contains subject matter related to Japanese Patent Application No. 10-305796 filed in the Japanese Patent Office on Oct. 27, 1998, and Japanese Patent Application No. 11-032862 filed in the Japanese Patent Office on Feb. 10, 1999, the entire contents of which are hereby incorporated by reference.

What is claimed as new and is desired to be secured by Letters Patent of the United States is:

1. A fusing device, comprising:

a fusing roller which fuses toner images on a sheet;

a pressure roller which contacts said fusing roller with pressure; and a driving device for driving said fusing and pressure rollers;

wherein said driving device drives said fusing and pressure rollers so as to satisfy the following inequality:

$$D_{fr}/D_{pr}<N_{pr}/N_{fr},$$

where $D_{fr}$ is a diameter of said fusing roller, $D_{pr}$ is a diameter of said pressure roller, $N_{fr}$ is a number of rotations of said fusing roller, and $N_{pr}$ is a number of rotations of said pressure roller, said driving device further comprises at least one fusing roller gear which is provided at an end of said fusing roller, and at least one pressure roller gear which is provided at an end of said pressure roller and is engaged with said at least one fusing roller gear, said at least one fusing roller gear comprises first and second fusing roller gears disposed at both ends of said fusing roller, and said at least one pressure roller gear comprises first and second pressure roller gears disposed at both ends of said pressure roller.

2. The fusing device according to claim 1, wherein said driving device drives said fusing and pressure rollers so as to satisfy the following inequality:

$$D_{fr}/D_{pr}<T_{fr}/T_{pr},$$

where $D_{fr}$ is a diameter of said fusing roller, $D_{pr}$ is a diameter of said pressure roller, $T_{fr}$ is a number of teeth of said at least one fusing roller gear, and $T_{pr}$, is a number of teeth of said at least one pressure roller gear.

3. A fusing device, comprising:

a fusing roller which fuses toner images on a sheet;

a pressure roller which contacts said fusing roller with pressure; and a driving device for driving said fusing and pressure rollers;

wherein said driving device drives said fusing and pressure rollers so as to satisfy the following inequality:

$$D_{fr}/D_{pr}\leqq(N_{pr}/N_{fr})/1.015$$

where $D_{fr}$ is a diameter of said fusing roller, $D_{pr}$ is a diameter of said pressure roller, $N_{fr}$ is a number of rotations of said fusing roller, and $N_{pr}$ is a number of rotations of said pressure roller, said driving device further comprises at least one fusing roller gear which is provided at an end of said fusing roller, and at least one pressure roller gear which is provided at an end of said pressure roller and is engaged with said at least one fusing roller gear, said at least one fusing roller gear comprises first and second fusing roller gears disposed at both ends of said fusing roller, and said at least one pressure roller gear comprises first and second pressure roller gears disposed at both ends of said pressure roller.

4. The fusing device according to claim 3, wherein said driving device drives said fusing and pressure rollers so as to satisfy the following inequality:

$$D_{fr}/D_{pr}\leqq(T_{fr}/T_{pr})/1.015,$$

where $D_{fr}$ is a diameter of said fusing roller, $D_{pr}$ is a diameter of said pressure roller, $T_{fr}$ is a number of teeth of said at least one fusing roller gear, and $T_{pr}$ is a number of teeth of said at least one pressure roller gear.

5. A fusing device, comprising:

a fusing means for fusing toner images on a sheet;

a pressure means for contacting said fusing means with pressure; and a driving means for driving said fusing and pressure means;

wherein said driving means drives said fusing and pressure means so as to satisfy the following inequality:

$$D_{fr}/D_{pr}<N_{pr}/N_{fr},$$

where $D_{fr}$ is a diameter of said fusing means, $D_{pr}$ is a diameter of said pressure means, $N_{fr}$ is a number of rotations of said fusing means, and $N_{pr}$ is a number of rotations of said pressure means, said driving means further comprises at least one fusing gear means which is provided at an end of said fusing means, and at least one pressure gear means which is provided at an end of said pressure means and is engaged with said at least one fusing gear means, said at least one fusing gear means comprises first and second fusing gear means disposed at both ends of said fusing means, and said at least one pressure gear means comprises first and second pressure gear means disposed at both ends of said pressure means.

6. The fusing device according to claim 5, wherein said driving means drives said fusing and pressure means so as to satisfy the following inequality:

$$D_{fr}/D_{pr}<T_{fr}/T_{pr},$$

where $D_{fr}$ is a diameter of said fusing means, $D_{pr}$ is a diameter of said pressure means, $T_{fr}$ is a number of teeth of said at least one fusing gear means, and $T_{pr}$ is a number of teeth of said at least one pressure gear means.

7. A fusing device, comprising:

a fusing means for fusing toner images on a sheet;

a pressure means which contacts said fusing means with pressure; and a driving means for driving said fusing and pressure means;

wherein said driving means drives said fusing and pressure means so as to satisfy the following inequality:

$$D_{fr}/D_{pr}\leqq(N_{pr}N_{fr})/1.015,$$

where $D_{fr}$ is a diameter of said fusing means, $D_{pr}$ is a diameter of said pressure means, $N_{fr}$ is a number of rotations of said fusing means, and $N_{pr}$ is a number of rotations of said pressure means, said driving means further comprises at least one fusing gear means which is provided at an end of said fusing means, and at least one pressure gear means which is provided at an end of said pressure means and is engaged with said at least one fusing gear means, said at least one fusing gear means comprises first and second fusing gear means disposed at both ends of said fusing means, and said at least one pressure gear means comprises first and second pressure gear means disposed at both ends of said pressure means.

8. The fusing device according to claim 7, wherein said driving means drives said fusing and pressure means so as to satisfy the following inequality:

$$D_{fr}/D_{pr} \leqq (T_{fr}/T_{pr})/1.015,$$

where $D_{fr}$ is a diameter of said fusing means, $D_{pr}$ is a diameter of said pressure means, $T_{fr}$ is a number of teeth of said at least one fusing gear means, and $T_{pr}$ is a number of teeth of said at least one pressure gear means.

9. A fusing method, comprising:

fusing toner images on a sheet via a fusing roller;

contacting said fusing roller with pressure via a pressure roller;

driving said fusing and pressure rollers so as to satisfy the following inequality:

$$D_{fr}/D_{pr} < N_{pr}/N_{fr},$$

where $D_{fr}$ is a diameter of said fusing roller, $D_{pr}$ is a diameter of said pressure roller, $N_{fr}$ is a number of rotations of said fusing roller, and $N_{pr}$ is a number of rotations of said pressure roller;

providing at least one fusing roller gear at an end of said fusing roller:

providing at least one pressure roller gear at an end of said pressure roller and engaged with said at least one fusing roller gear;

providing first and second fusing roller gears disposed at both ends of said fusing roller as said at least one fusing roller gear; and providing first and second pressure roller gears disposed at both ends of said pressure roller as said at least one pressure roller gear.

10. The fusing method according to claim 9, further comprising driving said fusing and pressure rollers so as to satisfy the following inequality:

$$D_{fr}/D_{pr} < T_{fr}/T_{pr},$$

where $D_{fr}$ is a diameter of said fusing roller, $D_{pr}$ is a diameter of said pressure roller, $T_{fr}$ is a number of teeth of said at least one fusing roller gear, and $T_{pr}$ is a number of teeth of said at least one pressure roller gear.

11. A fusing method, comprising:

fusing toner images on a sheet via a fusing roller;

contacting said fusing roller with pressure via a pressure roller; and driving said fusing and pressure rollers so as to satisfy the following inequality:

$$D_{fr}/D_{pr} \leqq (N_{pr}/N_{fr})/1.015,$$

where $D_{fr}$ is a diameter of said fusing roller, $D_{pr}$ is a diameter of said pressure roller, $N_{fr}$ is a number of rotations of said fusing roller, and $N_{pr}$ is a number of rotations of said pressure roller;

providing at least one fusing roller gear at an end of said fusing roller;

providing at least one pressure roller gear at an end of said pressure roller and engaged with said at least one fusing roller gear;

providing first and second fusing roller gears disposed at both ends of said fusing roller as said at least one fusing roller gear; and providing first and second pressure roller gears disposed at both ends of said pressure roller as said at least one pressure roller gear.

12. The fusing method according to claim 11, further comprising driving said fusing and pressure rollers so as to satisfy the following inequality:

$$D_{fr}/D_{pr} \leqq (T_{fr}/T_{pr})/1.015,$$

where $D_{fr}$ is a diameter of said fusing roller, $D_{pr}$ is a diameter of said pressure roller, $T_{fr}$ is a number of teeth of said at least one fusing roller gear, and $T_{pr}$ is a number of teeth of said at least one pressure roller gear.

13. A computer readable medium storing computer instructions for performing the steps recited in anyone of claims 17, 19, 21 and 23.

* * * * *